US005887818A

United States Patent [19]

Kelley

[11] Patent Number: 5,887,818

[45] Date of Patent: Mar. 30, 1999

[54] DEVICE AND METHOD FOR STORING MULTIPLE ROLLS OF TISSUE AND DISPENSING TISSUE THEREFROM

[76] Inventor: Treva J. Kelley, HC60, Box 1994A, Lakeview, Oreg. 97630

[21] Appl. No.: 795,471

[22] Filed: Feb. 4, 1997

[51] Int. Cl.[6] ..... B65H 19/00

[52] U.S. Cl. ..... 242/559.3; 242/560.2; 242/597.7; 312/34.22

[58] Field of Search ..... 242/597.7, 560.2, 242/559.3; 312/34.22

[56] References Cited

U.S. PATENT DOCUMENTS

| | | | |
|---|---|---|---|
| D. 260,828 | 9/1981 | Cordray et al. | D6/97 |
| D. 286,962 | 12/1986 | Ruiz | D6/521 |
| D. 307,086 | 4/1990 | Van Marcke et al. | D6/520 |
| D. 314,301 | 2/1991 | Cooke | D6/520 |
| D. 330,984 | 11/1992 | Evans | D6/520 |
| D. 356,459 | 3/1995 | Echeverri | D6/520 |
| D. 371,483 | 7/1996 | Haarmeyer et al. | D6/520 |
| 1,570,358 | 1/1926 | Levine . | |
| 2,534,290 | 12/1950 | Moskowitz | 206/56 |
| 2,991,951 | 7/1961 | Carroll | 242/55.42 |
| 3,370,805 | 2/1968 | Barbee | 242/597.7 X |
| 4,177,958 | 12/1979 | Poole | 242/55.42 |
| 4,432,451 | 2/1984 | Hooser | 242/560.2 X |
| 4,463,912 | 8/1984 | Grunerud | 242/55.42 |
| 4,487,376 | 12/1984 | Compton | 242/597.7 X |
| 4,607,809 | 8/1986 | Sineni et al. | 242/55.3 |
| 4,765,475 | 8/1988 | Kayserrian | 242/560.2 X |

FOREIGN PATENT DOCUMENTS

| | | | |
|---|---|---|---|
| 2077700 | 12/1981 | United Kingdom | 242/560.2 |

*Primary Examiner*—Donald P. Walsh
*Assistant Examiner*—Emmanuel M. Marcelo
*Attorney, Agent, or Firm*—Klarquist Sparkman Campbell Leigh & Whinston, LLP

[57] ABSTRACT

A device and method for dispensing and storing multiple rolls of rolled material dispensed on a spool, such as toilet paper, has a storage frame configured to hold the multiple rolls on a generally vertical shaft. The shaft extends upward from the bottom of the frame with the uppermost roll of material being freely accessible for use on the shaft. A lifting assembly is slidably secured to the shaft and positioned below the bottom roll of rolled material. During use, the lifting assembly is raised or lowered to position the uppermost roll of material for use. When the uppermost roll is depleted, any empty spool may be readily lifted from the top of the shaft and the lifting assembly raised again and secured in place to raise the next available roll of material for use. In a preferred embodiment, one face of the frame has an upwardly extending slot and a plurality of notches extending generally perpendicular from the slot at predetermined distances along the slot. An elongated lifting arm secured to the lifting assembly extends through the slot to permit the lifting assembly to be held in a desired position along the length of the shaft by engaging the lifting arm in the appropriate adjacent notch. The lifting arm assembly also serves as a visual and physical indicator of how many rolls of toilet paper remain on the shaft.

7 Claims, 1 Drawing Sheet

DEVICE AND METHOD FOR STORING MULTIPLE ROLLS OF TISSUE AND DISPENSING TISSUE THEREFROM

FIELD OF THE INVENTION

The present invention relates to an improved device for dispensing and storing rolled materials, particularly rolled toilet paper.

BACKGROUND OF THE INVENTION

As most users of the familiar one-roll toilet paper holder installed in most homes have encountered at one point or another, the primary problem with this device is that it does not provide for the storage or easy replacement of additional rolls of toilet paper. Upon depletion of the installed roll, a new roll must be located and installed. A previous user of the toilet may have left only a small amount of paper remaining on the roll. Unless an extra roll is stored nearby, a subsequent user may be left without a sufficient supply of toilet paper. In many cases, the storage of an extra roll of paper near the toilet is aesthetically unappealing.

Moreover, many visually or physically challenged individuals lack the requisite dexterity and other motor or visual skills required to remove and install a roll of toilet paper on the familiar holder. The familiar holder stores the single roll of toilet paper on a longitudinally retractable dowel. The roll of toilet paper may spin about the dowel, which is usually spring-biased to an unretracted position and secured horizontally in a mounting bracket secured on a wall adjacent to the toilet. The toilet paper is secured to the dowel of the familiar toilet paper holder by inserting the dowel through a cardboard cylinder, which serves as a spool for the rolled toilet paper. The dowel is then retracted along its length, usually by using two hands, and inserted into a suitable mounting bracket on the wall. Releasing the dowel allows it to return to its unretracted position within the mounting bracket, thereby securing the dowel, and the roll of toilet paper, in place.

When the supply of rolled toilet paper on the spool is depleted, the spool must be removed from the dowel before a new roll of toilet paper may be installed. The ends of the retractable dowel may be grasped and pressed longitudinally toward each-other, thereby releasing the dowel from its mounting bracket and permitting the spool to be removed. Alternatively, if the user has sufficient strength and dexterity, the spool may be ripped from the dowel. However, physically challenged people, such as people suffering with arthritis, may not be able to retract the dowel to permit removal and replacement of the toilet paper roll. As a result, many physically or visually challenged people are forced to rely on the assistance of others for such a relatively simple task.

In addition, because the familiar holder is secured to a wall, it may be inaccessible, or at least inconvenient, to physically challenged individuals.

Several inventors have recognized the first problem with known toilet paper dispensers and have provided a toilet paper dispenser that also stores extra rolls of toilet paper. See, for example, U.S. Pat. No. 2,534,290 to Moskowitz and U.S. Pat. No. 4,177,958 to Poole. The patents to Moskowitz and Poole disclose inventions stacking multiple rolls of toilet paper vertically within a housing. However, these devices offer no simple or easy to use mechanism for installing the rolls of toilet paper or for moving a stored roll into an optimal position for being used following the exhaustion of paper from a previous roll.

For example, Moskowitz discloses stacking the rolls of paper in a cylinder with an endless tape secured to a cylinder cover and extending through the spools of the paper and encircling the stacked rolls of toilet paper. In order to use the Moskowitz invention, the user must lift the cover, which in turn lifts the rolls of toilet paper. Presumably, the user of the Moskowitz invention must simultaneously hold the cover while attempting to unroll sheets of toilet paper from one of the rolls extending below the cover. Likewise, the Poole invention discloses a pedestal having a dispenser with a spindle for receiving one roll of toilet paper on top and a storage compartment extending below it. When the roll of paper on the spindle is depleted, the user must remove a replacement roll from the storage compartment and install it on the spindle. Because of the lack of adequate means for advancing from the used and stored rolls of toilet paper, neither of these devices are particularly useful or helpful, especially for physically or visually challenged individuals.

Similarly, many of the known multiple-rolled toilet paper dispensers and storage devices are aimed for use primarily in public restrooms where theft-prevention of the toilet paper and restricting the free rotation of the toilet paper, rather than ease of use, are primary concerns. See, for example, U.S. Pat. No. 4,463,912 to Grunerud. Accordingly, rather ornate mechanisms have been designed to prevent individuals from gaining access to the stored rolls of paper before the primary rolls have been exhausted. For example, Grunerud discloses a rotatable dispenser with a means for vertically stacking and storing multiple rolls of toilet paper therein. During use, the user draws paper from the bottom of the dispenser. When that roll of paper is depleted, the user removes the cardboard spool by pulling a slide plate outwardly. This action triggers a complex mechanism that drops a new roll of paper in place. Such mechanisms are not particularly applicable for use in the home, where theft and loss prevention are not at issue, and they are not particularly easy to use, especially by physically challenged individuals. Moreover, such complex mechanisms increase the expense of such devices and are not particularly attractive, further limiting the market for such products for home use.

Some inventors have attempted to provide an aesthetically desirable multi-rolled residential toilet paper holder that also offers a relatively simple mechanism for installing the rolls of paper and for moving a stored roll into an optimal position for being used following the exhaustion of paper from a previous roll. See e.g. U.S. Pat. No. 2,991,951 to Carroll and U.S. Pat. No. 4,607,809 to Sineni et al. However, these devices are not particularly easy to fill with toilet paper or use, especially for physically and visually challenged individuals.

U.S. Pat. No. 2,991,951 to Carroll discloses a columnar toilet paper dispenser and container secured to a wall. The toilet paper is secured on a dowel which extends longitudinally within the dispenser with gravity urging the paper downward. An open area at the lower end of the dispenser permits the roll of paper positioned at the bottom of the container to be used. An opening at the top of the container permits additional rolls to be added to the dowel. A pivotally adjustable U-shaped bail extends across the opening at the lower end of the dispenser such that it may block the stored rolls of toilet paper from falling into the open area at the bottom of the container until they are needed for use. Upon completion of the roll of paper at the bottom of the dispenser, the user must tear the cardboard roll off the dowel and swing the bail outward to permit another roll to fall into place. The user must then lift the rolls of paper remaining on the dowel above the area occupied by the bail, and return the bail to its original position thereby securing these additional rolls of paper out of the way of the new roll of paper positioned to be used. As with traditional one-roll toilet paper holders, such activities are particularly difficult for physically or visually challenged individuals.

U.S. Pat. No. 4,607,809 to Sineni discloses a cylinder made of deformable material. The cylinder can hold multiple rolls of toilet paper which can be elevated to the top of the cylinder by means of a rod running across the interior of the cylinder. The rod is locked into place by twisting it: the height of the rod as viewed in cross section is greater than the width of the groove provided in the cylinder, such that twisting the rod deforms the cylinder and wedges the rod in place. Indicator marks positioned on the exterior surface of the cylinder provide a visual reference as to when the rod is properly positioned to permit the top roll to be accessed easily. All the rolls are concealed from view by a cover. Apparently, Sineni offers only a means for storing toilet paper when not in use, it does not describe any means for dispensing individual sheets of toilet paper from the rolls themselves. Moreover, the wedging of the rod within the deformable slot may be particularly difficult for individuals who are physically or visually challenged to perform easily or consistently.

Accordingly, despite these attempts, there remains a need for an aesthetically pleasing toilet paper holder that is capable of storing multiple rolls of toilet paper while still permitting easy and unrestricted dispensing of individual tissues from a roll of toilet paper, easy removal of the cardboard cylindrical spool upon exhaustion of that roll, easy replacement of the exhausted roll with one that is stored in the holder, and easy filling of the holder with rolls of toilet paper.

SUMMARY OF THE INVENTION

Accordingly, there remains a need for an improved toilet paper dispenser and storage device that will fulfill the foregoing needs. This is the primary objective of the invention. More specific objectives of the invention are to provide a toilet paper dispenser and storage device that:

(1) provides for the convenient storage and use of multiple rolls of rolled material, such as toilet paper;

(2) provides a self-contained, free-standing, and portable rolled material dispenser and storage device that may be optimally positioned by each individual user;

(3) permits the easy filling of the device with rolled materials, such as toilet paper;

(4) permits easy dispersal of sheets of toilet paper from one roll at a time;

(5) permits easy accessibility to the roll of rolled material being dispensed;

(6) permits easy removal of any cylindrical spool remaining after exhaustion of the rolled material from that roll without the need to rip or tear the spool from the dispenser or perform other maneuvers which may be difficult for physically challenged individuals;

(7) permits easy replacement of an exhausted roll with one that is stored in the holder without the need to perform maneuvers which may be difficult for physically challenged individuals;

(8) provides easily identifiable confirmation for both sighted and visually-challenged individuals that the roll of rolled material to be used is properly positioned for use;

(9) permits easy detection of the number of rolls of rolled material remaining for both sighted and visually-challenged individuals;

(10) provides an aesthetically pleasing container that substantially conceals the stored rolls of rolled material from view; and

(11) provides a low cost, easy to maintain, reliable, simple, easy to use, and inexpensive to construct solution to the known problems of rolled material dispensers and storage devices.

The invention is an improved device for dispensing and storing multiple rolls of rolled material, usually on spools, such as toilet paper. The device has a storage frame, or housing, configured to hold multiple toilet paper rolls on a central generally vertical shaft. The shaft extends upward from the bottom of the frame with the uppermost roll of material being freely accessible for use on the shaft. A lifting assembly, including a roll lifting platform and lifting arm, is slidably secured to the shaft and positioned below the bottom roll of rolled material. During use, the lifting assembly is raised or lowered to position the uppermost roll of material for use. When the uppermost roll is depleted, the empty spool may be readily lifted from the top of the shaft and the lifting assembly raised again and secured in place to raise the next available roll of material for use. The rolled material dispenser and storage device may be refilled by returning the lifting assembly to a lower position and securing additional rolls of rolled material on the shaft as needed.

In a preferred embodiment, the device is used as a toilet paper dispenser and storage device. One face of the frame has an upwardly extending slot intersected by notches extending generally perpendicular to the slot at predetermined intervals therealong corresponding to the width of a roll of the paper. An elongated lifting arm secured to a lifting platform of the lifting assembly extends through the slot to permit the lifting platform to be held in a desired position along the length of the shaft by engaging the lifting arm in the appropriate adjacent notch. The lifting arm also serves as a visual and physical indicator of how many rolls of toilet paper remain supported on the platform. The frame is a freestanding cylindrical tower mounted on a base and constructed of wood, and the shaft is a wood dowel. Also, the lifting assembly, including its platform and lifting arm, is constructed of wood and has a tubular sleeve, preferably of polyvinyl chloride ("PVC") or other low-friction material, secured therethrough for slidably engaging the dowel. All exposed surfaces of the frame and lifting assembly are suitably shaped and finished to provide an aesthetically pleasing toilet paper dispenser and storage device suitable for display in a household bathroom.

The foregoing and other objects, features and advantages of the invention will become more apparent from the following detailed description of preferred embodiments which proceeds with reference to the accompanying drawings.

DETAILED DESCRIPTION OF A PREFERRED EMBODIMENT

Figures 1, 2, 3, 4:
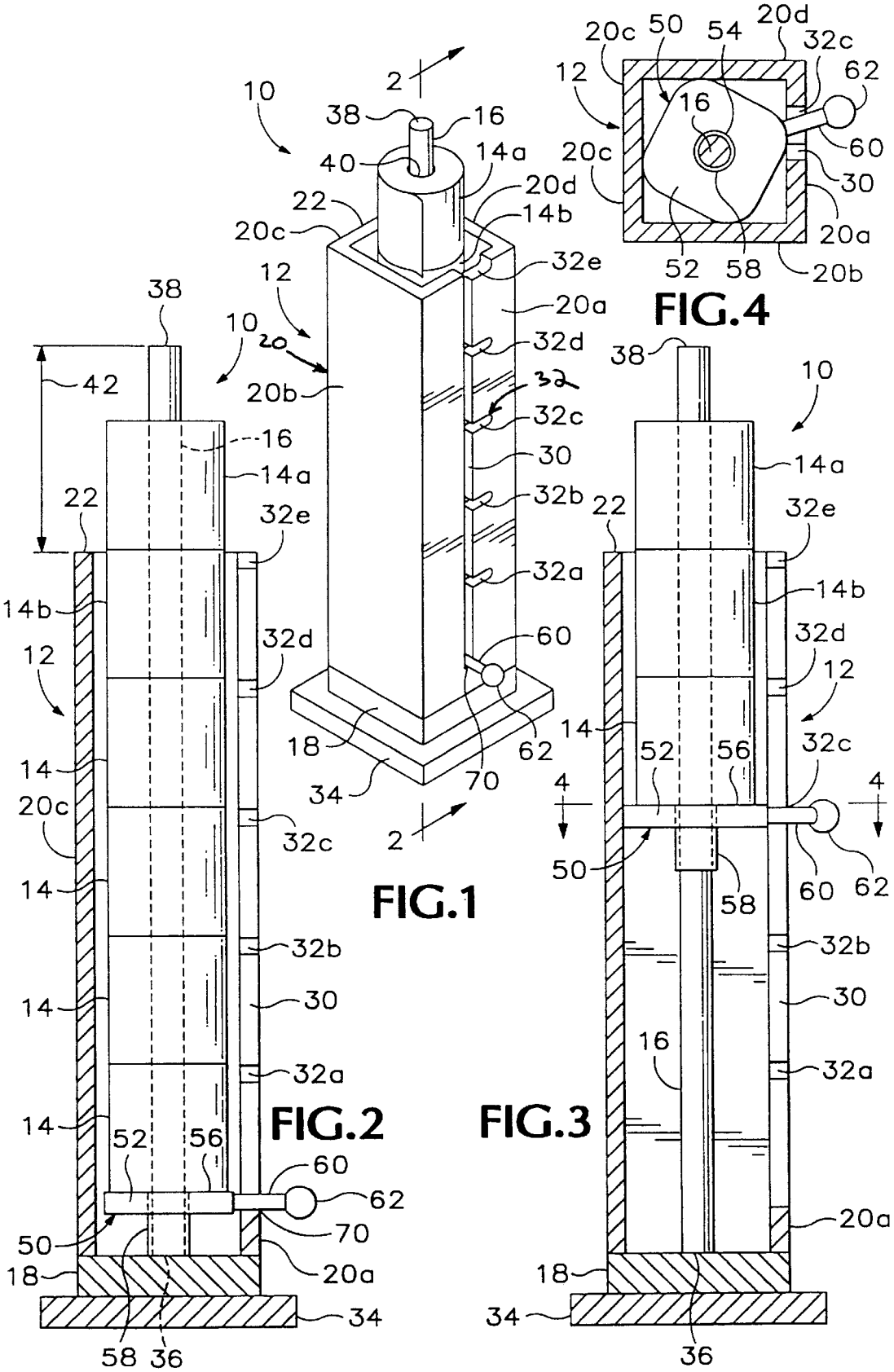
FIG. 1 is a perspective view of the improved rolled material dispenser and storage device in accordance with a preferred embodiment of the present invention.
FIG. 2 is an enlarged vertical sectional view taken along line 2—2 of FIG. 1 showing the lifting assembly of the device in its lowermost position.
FIG. 3 is an enlarged vertical sectional view of the device of FIG. 1, similar to that of FIG. 2, but showing the lifting assembly in a partially raised position.
FIG. 4 is an enlarged cross-sectional view taken along line 4—4 of FIG. 3.

A rolled material dispenser and storage device 10 in accordance with a preferred embodiment of the invention is shown in FIGS. 1–4.

General Assembly

Referring to FIGS. 1–4, the rolled material dispenser and storage device 10 includes a hollow, box-like, cylindrical housing, or frame, 12 defined by four sidewalls 20 and a bottom wall, or base plate, 18 closing the lower end of the housing. The housing is open at its upper end and supported in a free-standing, upright position on a stand plate 34. The housing is sized to store a stack of multiple paper rolls 14 on a vertical shaft, or dowel, 16 mounted centrally within the housing on base plate 18 and extending outwardly beyond its open upper end.

A lifting assembly 50 for lifting the stack of rolls along the shaft such that one roll at a time may occupy, successively, the upper end of the shaft 16 is mounted within the housing below the stack of paper rolls. The lifting assembly includes a roll lifting platform 52 slidable on shaft 16 within the housing, and a lifting arm 60 secured to the platform and extending horizontally outwardly of the housing through a vertically extending slot 30 in one of sidewalls 20. A series of notches 32 extending laterally from slot 30 at regular intervals therealong selectively receive lifting arm 60 to hold the lifting platform at a selected elevation for exposing a paper roll for use at the upper end of the shaft 16 just above the upper end of housing 12.

Housing Details

The storage frame, or housing, 12 is configured and sized to hold therein multiple spooled toilet paper rolls 14 vertically in a stack with their spools 40 received on a central longitudinal generally vertical shaft 16. As best shown in FIG. 1, the tubular frame 12 is closed at its lower end by a square base plate 18 and is defined vertically by four rectangular-shaped side walls 20*a*, 20*b*, 20*c*, 20*d* joined together to form a rectangular-shaped, tubular box in which the stack of toilet paper rolls 14 is received. The tubular frame 12 includes an open upper end 22 opposite base plate 18.

The side walls 20*a*, 20*b*, 20*c*, 20*d* and base plate 18 may be constructed of a suitable non-deformable material, such as wood, plastic, or metal. However, wood is preferable because it can be finished and stained to provide an aesthetically pleasing appearance and to match other bathroom decor. Preferably, the length of side walls 20*a*, 20*b*, 20*c*, 20*d* is sufficient to permit five toilet paper rolls 14 to be received within the box as shown.

As best shown in FIG. 1, one side wall of frame 12, here side wall 20*a*, has a vertical slot 30 extending along its centerline from adjacent base plate 18 to its upper end. A plurality of notches, in this case five notches 32*a*, 32*b*, 32*c*, 32*d*, 32*e*, in sidewall 20*a* intersect the slot at regular intervals along the length of the slot 30. The notches 32*a*, 32*b*, 32*c*, 32*d*, 32*e*, extend generally perpendicularly from slot 30 and are spaced apart a distance that corresponds generally to the width of a roll of toilet paper or other rolled material being stored and dispensed. The purpose of slot 30 and notches 32*a*, 32*b*, 32*c*, 32*d*, 32*e* will be more fully explained below.

Preferably, the base plate 18 is rigidly secured to a larger stand plate 34 to permit the frame 12 to stand freely as shown in FIG. 1. Alternatively, the stand plate 34 may be omitted to permit the box to be rigidly secured to a wall. For this purpose, a wall-mounting bracket (not shown) or other suitable wall-mounting means could be provided on one of the sidewalls other than the slotted side wall 20*a*.

The shaft 16 has a secured end 36 and a free end 38, with the secured end 36 rigidly secured centrally within frame 12 at the center of the base plate 18, preferably with a bored hole (not shown) in the base plate 18. The shaft 16 may be secured within the bore by adhesive or fasteners, or both. The shaft 16 has a circular cross-section that permits the cardboard spool 40 of a toilet paper roll 14 to easily slide along and rotate about it. The shaft 16 extends generally vertically from the base plate 18 within the frame 12 with its free end 38 extending above the open end 22 of the frame 12 defining an unrolling section 42 of the shaft 16 to permit a toilet paper roll 14 to be easily accessed and unrolled when supported from below and positioned on the unrolling section 42 of the shaft 16 slightly above the open end 22 of the frame 12.

The shaft 16 is constructed of a non-deformable material, such as wood, plastic, or metal. However, a wood dowel is preferable because it can be finished and stained to provide an aesthetically pleasing appearance and to match other bathroom decor.

Lifting Assembly Details

As best shown in FIG. 4, the lifting assembly 50 is slidably received on the shaft 16. The lifting assembly 50 includes a roll lifting platform 52 with a perpendicular central hole 54 extending therethrough for receiving the shaft 16 and an upper surface 56, optimally perpendicular to the longitudinal length of the shaft 16, of sufficient size to support a toilet paper roll 14 resting on its side, but not so large as to prevent the lifting platform 52 from fitting easily within the frame 12.

In order to permit the lifting assembly 50 to move freely along the shaft 16 and keep the upper surface 56 of the lifting platform 52 in its optimal position as it travels along the shaft 16, it is preferable to secure a tubular sleeve 58, preferably PVC tube or other low-friction material, to the lifting platform 52 to slidably engage the shaft 16. As best shown in FIGS. 2 and 3, the tubular sleeve 58 is secured within the central hole 54 in the lifting platform 52 and extends downward from the upper surface 56 of the lifting platform 52. The tubular sleeve 58 has an inner diameter to permit it to freely slide along the shaft 16, and an outer diameter to allow it to be rigidly secured, preferably by gluing, to the lifting platform 52.

As shown in FIGS. 1–4, an elongated lifting arm 60 is rigidly secured at one end to the lifting platform 52, preferably within a bored hole (not shown) in the lifting platform 52. The lifting arm 60 is preferably a cylindrical shaped dowel that may be secured within the bore by adhesive or fasteners, or both. The opposite end of the lifting arm 60 preferably includes a rounded knob 62 for ease of grasping and to make the lifting arm 60 more aesthetically pleasing. Also, the lifting platform 52, lifting arm 60, and knob 62 are constructed from suitable materials such as wood, plastic, or metal. They are preferably constructed of wood because it can be finished and stained to provide an aesthetically pleasing appearance.

As the lifting platform 52 travels along the shaft 16, the lifting arm 60 is positioned to travel along the slot 30 in the frame 12. Accordingly, with the lifting arm 60 positioned as shown in FIG. 1, the lifting platform 52 may be raised simply by lifting the lifting arm 60 along the slot 30. Similarly, by raising the lifting arm 60 along the slot 30 and sliding the lifting arm 60 into a notch 32*a*, 32*b*, 32*c*, 32*d*, 32*e*, the lifting platform 52 will raise to the level of the notch 32*a*, 32*b*, 32*c*, 32*d*, 32*e*, and remain in that position even if the lifting arm 60 is released.

Example of a Preferred Embodiment

One embodiment encompassing the features of the present invention shown in FIGS. 1–4 may be, for example, a frame in the shape of a rectangular box made from ¾ inch thick wood with a square base plate 18 measuring 6¾ inches square and having side walls 20*a*, 20*b*, 20*c*, 20*d*, 25 inches high should be sufficient to allow five traditional toilet paper rolls 14 to be received within the box.

For a storage frame of the dimensions described above, the slot received within one side wall 201 may be, for example, ½ inch wide and 23¼ inches long, with each notch 32*a*, 32*b*, 32*c*, 32*d*,32*e* being, for example, ½ inch wide and 1¼ inch long. The shaft 16 may have, for example, a diameter of 1¼ inches with an unrolling section 42 at least 6½ inches long. The lifting platform 52 may, for example, be 3½ inch square piece of wood with rounded corners and having a ¾ inch thickness and a 1⅜ inch diameter circular through hole 54 in the center of the square with the tubular sleeve 58 having an outer diameter of 1⅜ inches and a length of 3½ inches. Finally, the lifting arm 60 may have a cross-sectional diameter of ¼ inch and a length of 4 inches.

Operation

With the invention described as above, the use of the improved rolled material dispenser and storage device 10 is simple. To fill the device 10 with toilet paper rolls, the user positions the lifting arm 60 of the lifting assembly 50 at its lowest position 70 as shown in FIG. 1. The user then places up to six toilet paper rolls 14 on the shaft 16 as shown. The uppermost toilet paper roll 14*a* is ready for use and will rotate easily about the shaft 16 at the unrolling section 42 of the shaft 16 permitting a user easy access to the uppermost toilet paper roll 14*a*. The lifting arm 60 in its lowest position 70 alerts users of the device 10 that it is fully loaded.

When the uppermost toilet paper roll 14*a* becomes exhausted, the user simply removes the remaining cardboard cylindrical spool 40 by lifting it from the shaft 16. A user may grasp the lifting arm 60 and lift it along the slot 30, then secure the lifting arm 60 in the first notch 32*a*. As a result, the next available toilet paper roll 14*b* will raise into position. Preferably, the notches 32*a*, 32*b*, 32*c*, 32*d*, 32*e*, are positioned at the appropriate locations along the slot 30 to permit the next available toilet paper roll 14*b* to be fully exposed on the unrolling section 42 of the shaft 16 above the open end 22 of the frame 12. The lifting arm 60 positioned at the first notch 32*a* alerts users that one toilet paper roll 14 has been used.

This process may be completed several times as the uppermost toilet paper roll 14*a* becomes exhausted. For example, as shown in FIG. 3, three toilet paper rolls 14 have been used and the lifting assembly 50 is secured at the third notch 32*c*. As the stored supply of toilet paper rolls 14 becomes depleted, the lifting arm 60 serves as a physical and visual indicator of the amount of toilet paper rolls 14 remaining on the shaft. Moreover, the activities required to load the present invention with toilet paper rolls 14 and advance to the next available toilet paper roll 14*b* are significantly easier, even for physically-challenged individuals, than activities required to fill and use known devices.

In cases where especially soft toilet paper is installed on rolls, in order to ensure smooth rotation of the uppermost roll on the shaft, it is desirable to place a thin washer (not shown), preferably plastic and having a diameter at least as large as the diameter of the toilet paper roll, on the shaft 16 between the uppermost roll 14*a* and the next available roll 14*b*. In cases where the washer (not shown) is installed, it must be removed and reinstalled as the uppermost roll 14*a* is depleted and the next available roll 14*b* is advanced into position on the unrolling section 42 of the shaft 16.

Other Embodiments

The present invention may be readily modified for use in public places. For example, a locking end cap (not shown) having a diameter greater than the inner cross-sectional diameter of the toilet paper roll 14 may be secured at the free end 38 of the shaft using known materials and methods. The locking end cap would prevent the theft of the toilet paper rolls 14 from the shaft 16 while still permitting the device 10 to operate effectively as a toilet paper dispenser and storage device 10 as described. Alternatively, a locking through pin (not shown) could be installed at the free end 38 of the shaft 16 to achieve the same result as the locking end cap. Additionally, the frame 12, lifting assembly 50, and shaft 16 could be constructed with more durable materials such as metal.

Similarly, in order to conserve sheets of toilet paper, the shaft 16 shape and configuration may be modified using known methods to restrict the toilet paper roll's 14 ability to rotate about the shaft 16 freely.

Having described and illustrated the principles of the invention with reference to a preferred embodiment thereof, it will be apparent that this embodiment can be modified in arrangement and detail without departing from the principles of the invention. For example, any frame 12 having any overall shape, including cylindrical, may be used so long as it provides for securing the longitudinal shaft 16 for receiving the rolled toiled paper as described and permits the stack of toilet paper rolls 14 to be received and lifted. In addition, the upwardly extending slot 30 may take any form or path up the frame, such as a generally spiral or diagonal path, and the notches 32*a*, 32*b*, 32*c*, 32*d*, 32*e*, could be suitably modified to support the lifting arm 60 of the lifting assembly 50 accordingly.

Similarly, the shape and orientation of the notches 32*a*, 32*b*, 32*c*, 32*d*, 32*e* may be modified to prevent inadvertent rotation of the lifting arm out of them as the uppermost roll 14*a* is unrolled, say for example by placing a small pertubation (not shown) on the lower surface of each notch 32*a*, 32*b*, 32*c*, 32*d*, 32*e*, adjacent to the slot 30 or making each notch 32*a*, 32*b*, 32*c*, 32*d*, 32*e* slightly downslope away from the slot. Also, the lifting assembly 50 may be detachably secured in place along the shaft 16 by securing the lifting arm 60 to projections (not shown) positioned along the frame 12. One or more sides of the frame 12 could be open with the projections, such as pegs, extending generally horizontally from the frame 12. As with the notches 32*a*, 32*b*, 32*c*, 32*d*, 32*e* of the preferred embodiment, the projections may be positioned at the appropriate locations along the frame to permit the next available toilet paper roll 14*b* to be fully exposed on the unrolling section 42 of the shaft 16 above the open end 22 of the frame 12 when the lifting assembly 50 is raised and secured to the next available projection.

In addition, any type of other suitable materials could be used to construct the frame 12, shaft 16, and lifting assembly 50 including plastic, PVC, and metal. Also, although the present invention is primarily described for use in dispensing and storing toilet paper, the principles involved are equally applicable for dispensing and storing other rolled materials dispensed from a spool, such as paper towels, thread, wire, and cable.

Moreover, the unrolling section 42 of the shaft 16 may also be enclosed within the frame 12 with a suitable opening (not shown) being provided in the frame 12 adjacent the exposed length 42. With such a modification, a user could unroll the uppermost toilet paper roll 14*a* installed on the unrolling section 42 of the shaft through this opening (not shown), but the frame 12 would conceal a large portion of the uppermost toilet paper roll 14*a* from view, and thereby provide a different and possibly more aesthetically pleasing device 10 to some users. In such case, a removable or pivoting cover (not shown) may be placed on top of the frame 12 to further conceal the uppermost roll 14*a*, but still allow the device 10 to be easily filled as described.

Finally, the device 10 may be sized to accommodate more or less than six toilet paper rolls 14 at one time. The preferred embodiment was sized to accommodate six toilet paper rolls 14 simply because packages containing six toilet paper rolls 14 are becoming more commercially available. Moreover, in the event a person purchases the more familiar four-pack of toilet paper, the preferred embodiment allows any new supply of paper to be stored even though up to two additional toilet paper rolls 14 remain to be used.

In view of the wide variety of embodiments to which the principles of the invention can be applied, it should be apparent that the detailed embodiments are illustrative only and should not be taken as limiting the scope of the invention. Rather, the claimed invention includes all such modifications as may come within the scope of the following claims and equivalents thereto.

What is claimed is:

1. A device for dispensing and storing a plurality of rolls of rolled materials including:

a frame for receiving the plurality of rolls having a lower end;

an upright shaft for rotatably and slidably mounting a stack of said rolls, the shaft having a lower end secured to said lower end of said frame and an upper unrolling section accessible at an upper portion of the frame for dispensing materials from a roll while mounted on the shaft;

a lifting assembly movable on said shaft for lifting the stack along said shaft such that each roll of the stack may occupy, successively, said unrolling section of said shaft;

the lifting assembly and frame including a cooperable holder for holding the lifting assembly at selected positions along the shaft and thereby holding an upper roll of the stack at the unrolling section;

said frame including a housing having a wall defining an upright slot;

said lifting assembly including a lifting platform received within said frame and slidably secured to said shaft for supporting said stack;

an elongate lifting arm extending from said lifting platform and through said slot so that raising the lifting arm along the slot moves the lifting platform along the shaft;

a plurality of notches extending laterally from the slot, at regular spaced intervals along the slot; and said lifting arm being moveable into a selected one of said notches after moving the lifting platform to a desired level within the frame to thereby hold said lifting platform in place.

2. A device for dispensing and storing a plurality of rolls of rolled materials including:

a frame for receiving the plurality of rolls having a lower end;

an upright shaft for rotatably and slidably mounting a stack of said rolls, the shaft having a lower end secured to said lower end of said frame and an upper unrolling section accessible at an upper portion of the frame for dispensing materials from a roll while mounted on the shaft;

a lifting assembly movable on said shaft for lifting the stack along said shaft such that each roll of the stack may occupy, successively, said unrolling section of said shaft;

the lifting assembly and frame including a cooperable holder for holding the lifting assembly at selected positions along the shaft and thereby holding an upper roll of the stack at the unrolling section;

said unrolling section of the shaft extending above the frame for allowing a roll positioned on the unrolling section to be unrolled.

3. A device for dispensing and storing a plurality of rolls of rolled materials including:

a frame for receiving the plurality of rolls having a lower end;

an upright shaft for rotatable and slidably mounting a stack of said rolls, the shaft having a lower end secured to said lower end of said frame and an upper unrolling section accessible at an upper portion of the frame for dispensing materials from a roll while mounted on the shaft;

a lifting assembly movable on said shaft for lifting the stack along said shaft such that each roll of the stack may occupy, successively, said unrolling section of said shaft;

the lifting assembly and frame including a cooperable holder for holding the lifting assembly at selected positions along the shaft and thereby holding an upper roll of the stack at the unrolling section;

said lifting assembly including a lifting platform received within said frame and slidably mounted to said shaft for supporting said stack for movement along the shaft; and said holder including cooperative means on the lifting platform and on the frame for selective interengagement to hold the platform at a desired position along the shaft to expose a roll.

4. A method for storing and dispensing rolled toilet paper having sheets of paper comprising:

installing a plurality of rolls of toilet paper on a generally vertical shaft above a lifting platform slidably received on the vertical shaft, the shaft having an unrolling section near its upper end and received within a frame to form a stack of rolls;

raising the lifting platform along the shaft to position a roll of toilet paper at the unrolling section of the shaft;

using sheets of toilet paper from the roll of toilet paper positioned at the unrolling section of the shaft;

replacing the roll of toilet paper positioned on the unrolling section of the shaft upon its exhaustion of sheets of toilet paper by again raising the lifting platform along the shaft to position the next available roll from the stack of rolls on the unrolling section of the shaft; and securing the lifting platform in place by positioning a lifting arm secured to the lifting platform within a notch received within the frame.

5. A device for dispensing and storing a plurality of rolls of rolled materials including:

a frame for receiving the plurality of rolls having a lower end;

an upright shaft for rotatably and slidably mounting a stack of said rolls, the shaft having a lower end secured to said lower end of said frame and an upper unrolling section accessible at an upper portion of the frame for dispensing materials from a roll while mounted on the shaft;

a lifting assembly movable on said shaft for lifting the stack along said shaft such that each roll of the stack may occupy successively said unrolling section of said shaft;

the lifting assembly and frame including a cooperable holder for holding the lifting assembly at selected positions along the shaft and thereby holding an upper roll of the stack at the unrolling section;

said frame including a housing having a wall defining an upright slot;

said lifting assembly including a lifting platform received within said frame and slidably secured to said shaft for supporting said stack;

an elongate lifting arm extending from said lifting platform and through said slot so that raising the lifting arm along the slot moves the lifting platform along the shaft;

further including a tubular sleeve secured to said lifting platform for slidably engaging the shaft.

6. The device of claim 5, wherein said tubular sleeve is a length of PVC tube.

7. A device for storing multiple rolls of paper in a stack and dispensing paper from the uppermost roll in the stack, comprising:

an upright rigid hollow cylindrical housing having a closed lower end and an open upper end;

a shaft for receiving stacked rolls of paper, the shaft being secured to the closed lower end and extending centrally within the housing to an exposed end portion terminating above the upper end;

a platform slidably mounted on the shaft and extending transversely within the housing for supporting the stacked rolls, the platform being rotatable at least to some extent within the housing;

said housing defining a through slot extending parallel to the shaft and lengthwise of the housing, and multiple spaced apart notches extending transversely from the slot at intervals therealong: and a lifting arm secured to the platform and extending through the slot for lifting a stack of rolls on the platform for exposing a roll for dispensing above the upper end on the exposed end portion of the shaft, said lifting arm being operable to rotate the platform and thereby position the arm within a selected notch to hold the platform at a desired level within the housing for maintaining a supported roll on the exposed end portion of the shaft.

* * * * *